United States Patent [19]

Stahl

[11] 4,062,261

[45] Dec. 13, 1977

[54] KEY CUTTING APPARATUS

[75] Inventor: Allen Andrew Stahl, Gaithersburg, Md.

[73] Assignees: Alvin M. Chanin, Philadelphia, Pa.; Robert Chanin, Denwood, Md.; Robert J. Mooney, Warminster, Pa. ; a part interest

[21] Appl. No.: 732,403

[22] Filed: Oct. 14, 1976

[51] Int. Cl.[2] ..... B26D 7/06

[52] U.S. Cl. ..... 83/414; 83/917; 90/13.05; 83/522; 83/278

[58] Field of Search ..... 83/917, 414, 412, 422, 83/276, 278, 522, 413; 90/13.05

[56] References Cited

U.S. PATENT DOCUMENTS

| | | | |
|---|---|---|---|
| 3,719,115 | 3/1973 | Muri | 83/414 |
| 3,748,940 | 7/1973 | Muri | 83/414 |
| 3,971,278 | 7/1976 | Wich | 83/413 |
| 3,981,214 | 9/1976 | Wich | 83/414 |

*Primary Examiner*—Donald R. Schran
*Attorney, Agent, or Firm*—Robert J. Mooney

[57] ABSTRACT

A key cutting apparatus for cutting a series of longitudinally spaced notches in the blade of a key blank according to specifications set forth in key manufacturer's code books. The apparatus includes a cutter mounted on a base, a carriage assembly movably mounted on the base for controllable movement toward and away from the cutter; the carriage assembly includes a sub-carriage adapted for controllable independent movement in a direction perpendicular to the carriage assembly movement. A key blank clamping assembly secured to the sub-carriage holds the key blank for the cutting operation and cooperates with positioning means which effects proper positioning of the key blank to permit cutting of the first notch at a code book specified distance from a reference point which is generally the key blank shoulder. The remaining notches are equidistantly spaced from each other along the remaining portion of the key blank blade. A variable spacing control assembly allows selection of this spacing. A pivotable index arm cooperates with the sub-carriage and the variable spacing control assembly to accurately convert an incremental arcuate motion of the index arm into an incremental retilinear motion of the sub-carriage to thereby correctly position the blade of the key blank for cutting of the remaining notches.

9 Claims, 21 Drawing Figures

KEY CUTTING APPARATUS

FIELD OF INVENTION

This invention relates to key cutting apparatus for cutting notches in the blade of a key blank according to a specified code and, more particularly, to a key cutting apparatus which is adjustable to selectively cut a wide variety of different keys, having varing notch depths and having notches positioned at varing longitudinal intervals along the blade of the key blank.

BACKGROUND OF THE INVENTION

Key cutting machines are of two general types, either the duplicating type or the code cutting type. Duplicating type machines generally utilize a follower riding along the bittings (notches) of an existing key to guide the path of a cutter wheel which cuts a key blank. The present invention relates to code cutting type machines which are used by locksmiths to cut key blanks in the absence of an existing key which can be duplicated. Code books are published listing the longitudinal spacing of the notches along the blade of the key blank and the depth increments of the notches for keys which are utilized to open substantially all types of locks. By following the specifications in the code books, a locksmith can manually cut the proper notches in a key blank to duplicate a lost or misplaced key, but such manual cutting is time-comsuming and expensive.

Machines which are particularly adapted to code cutting have been provided, but, the known machines are all of the type wherein code cutting is accomplished with preformed and replaceable cams, plates, or discs which are used to control the relative movement and positions of the key blank and the cutter. With these prior art machines, a set of removable cams, plates, or discs is provided for each different type key. When a key for a particular lock is to be cut, the set of cams, plates or discs corresponding thereto is placed on the machine and is used to control the relative travel of a key blank which is brought into cutting engagement with a cutter such that the notches will be cut at the proper intervals and to the proper depths.

Because of the large number of lock manufacturers, and the many different types of locks manufactured by each manufacturer, a full complement of such prior art cams, plates or discs represents an expensive investment and less than a full complement tends to limit the use of the prior art machines. Moreover, many of these coded cams, plates and discs are not readily available for a large number of locks now in common use.

SUMMARY OF THE INVENTION

Accordingly, it is an object of this invention to provide a key cutting apparatus which does not employ coded discs, cams or plates. It is a further object of this invention to provide a key cutting apparatus which will accurately cut a key from a key blank. It is a further object of this invention to provide a key cutting apparatus which reliably and accurately cuts a wide variety of keys. It is a further object of this invention to provide a key cutting apparatus which cuts keys having different center-to-center distances between notches. It is a further object of this invention to provide a key cutting apparatus which will cut notches in agreement with required depth increments specified by lock manufacturers. These and other objects are accomplished as follows.

Apparatus constructed according to the present invention eliminates the necessity of providing a specially coded cam, disc or plate for each different type of key to be cut. The apparatus removes material from the blade of a key blank in accordance with a distinct regimen selected for a particular key from a code book supplied by the manufacturer of a key.

The apparatus includes a cutter mounted on a base. The cutter is housed in, and registered with, a cutter stand and is arranged to move reciprocally in a plane perpendicular to the base. As many as four cutting faces can be provided on the cutter to further facilitate the cutting of a wide variety of key types. The cutter can be easily removed from the cutter stand and re-registered with the cutter stand to thereby place a different cutter face in confrontation with a key blank. The center line of a confronting cutter face establishes the machine datum.

The apparatus further includes a carriage assembly movably mounted on guides formed from beveled uprights secured to the base. The entire carriage assembly is arranged to be moved toward and away from the cutter to effect control of the depth of the notches to be cut in the blade of a key blank. The carriage assembly includes a lateral carriage and a longitudinal carriage. The lateral carriage moves toward and away from the cutter on the base guides and carries the longitudinal carriage with it during this motion; specially oriented beveled guides provided on the upper surface of the lateral carriage not only assure this combined motion but also allow the longitudinal carriage to move independently of the lateral carriage in a direction perpendicular to that of the carriage assembly as a whole. That is, the longitudinal carriage is arranged for independent rectilinear motion in a direction oriented 90° from machine datum.

A key blank clamping assembly and a positioning means are secured to the upper surface of the longitudinal carriage. The positioning means accurately positions the key blank with respect to the cutter for the first notch to be cut. The first notch in the blade of the key blank is located at a code book specified distance from a reference point on the key, usually the shoulder but sometimes the tip of the key blank blade. A dial indicator associated with the positioning means indicates when the positioning means has located the key blank at the "first cut distance" selected from the code book. After the key blank has been properly located for the first notch cutting, it is clamped to the longitudinal carriage with the clamping assembly. After the carriage assembly is adjusted to effect proper depth selection, the first notch is cut into the blade of the key blank with the cutter.

In addition to the first notch, usually four or five additional notches must be cut into the key blank blade. These additional notches are equidistantly spaced from each other along the remaining portion of the blade. The distance between the additional notches is also specified in key manufacturer's code books. Since the apparatus of the present invention is designed to cut a wide variety of keys having a wide variety of differing inter-notch distances, the apparatus is provided with a variable spacing control assembly and an index arm which both cooperate with the longitudinal carriage to move the longitudinal carriage in equal linear increments across the face of the cutter.

The index arm is provided with an elongated slot intermediate its ends. One end of the index arm is pivotally mounted on the lateral carriage; the other end of the index arm is provided with an index pin which is selectively engagable with any one of a plurality of index holes located in the lateral carriage. The index arm is arranged to slide between the upper surface of the lateral carriage and the lower surface of the longitudinal carriage in an arcuate manner.

That portion of the longitudinal carriage which overlays the index arm is also provided with a slot which is normally aligned with the slot in the index arm. The variable spacing control assembly is slidable along the lengths of both normally aligned slots and is arranged to be secured to the index arm at any selected point along the length of the aligned slots. The point at which the variable spacing control assembly is clamped to the index arm is determined by the required internotch distance for the particular key to be cut. If this distance is small, the variable spacing control assembly is moved toward the pivot point of the index arm; if this distance is large, the variable spacing control assembly is moved along the slots toward the index pin and away from the index arm pivot point. A setting scale is provided to aid this selection.

A portion of the variable spacing control assembly, a cylindrical pusher, is designed to engage the side walls of the slot in the longitudinal carriage to transfer motion from the index arm to the longitudinal carriage which is constrained by the specially oriented beveled guides on the upper surface of the lateral carriage to move in a rectilinear manner across the face of the cutter. After the variable spacing control assembly is clamped to the index arm, the index pin can be sequencially registered with each of the index holes causing the index arm to move in an incremental arcuate fashion. Part of this motion is transfered by the pusher to the longitudinal carriage which then moves in an incremental linear fashion. The length of each linear increment is equal to the required inter notch distance for the particular key to be cut.

Each notch is cut by ensuring that the index pin is registered with an index hole which corresponds with the notch to be cut. For example, after the first notch has been cut, the index pin is moved from the first index hole to the second index hole. This action moves the longitudinal carriage, and the key blank which is clamped to it, a known linear distance across the face of the cutter. The carriage assembly is then adjusted toward or away from the cutter to select a required notch depth. The cutter is then operated and the key blade is notches.

Other objects, advantages and novel features of the invention will become apparent from the following detailed description of the invention when considered in conjunction with the accompanying drawings.

DESCRIPTION OF THE PREFERRED EMBODIMENT

Figure 10:
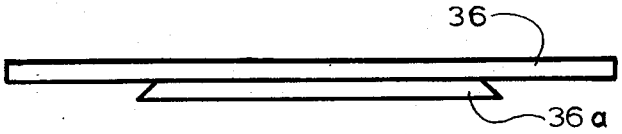
FIG. 10 is a side elevational view of a longitudinal carriage and its downwardly directed guide plate which are elements of the carriage assembly illustrated in FIG. 4.
Figure 11:
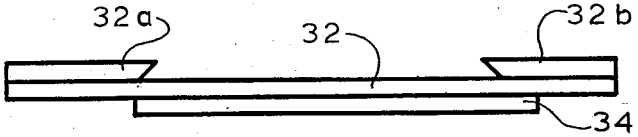
FIG. 11 is a side elevational view of a lateral carriage and its associated guide plates which are elements of the carriage assembly illustrated in FIG. 4.
Figure 1C:
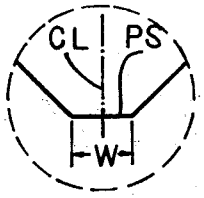
FIG. 1C shows in detail a typically shaped pin seat and side slopes of one notch cut in the key of FIG. 1B.
Figure 1B:
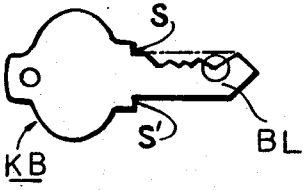
FIG. 1B is a side elevational view of a two-shouldered key with the original key blank illustrated in phantom.
Figure 1A:
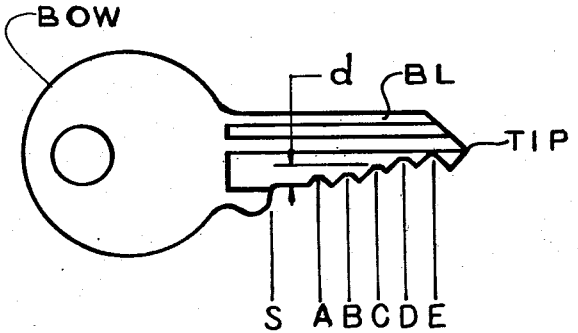
FIG. 1A is a side elevational view of a one-shouldered, notched key blank.

Referring to FIGS. 1A and 1B a single shouldered key and a double shouldered key, respectively, are shown. As is wellknown, keys are formed from key blanks, shown in phantom in FIG. 1B, by cutting or notching the key blank, KB, at predetermined intervals along the length of the blade, BL, of the key blank, KB.

Each lock manufacturer identifies each lock and associated key with a distinct code number. With the code number and code books provided by the manufacturers, a locksmith can determine the number of bittings or notches which must be cut along the blade BL of the key blank KB, as well as the longitudinal spacing of the notches and the depths, *d*, of the notches to be cut from the blade BL of the key blank KB.

Referring to FIG. 1A the longitudinal position of most code required notches are measured from a reference point on the key blank, usually the shoulder, S. The first notch, A, is spaced a given distance from the shoulder, S, and all remaining notches, such as B, C, D and E, are spaced equidistantly from each other and the first notch, A, by an amount specified by the code books for a particular key as shown in FIG. 1A. That is, the center-to-center distances A–B, B–C, C–D, and D–E are equal and are measured from the center lines CL of the notch lands or pin seats, PS. (See FIG. 1C).

(Some types of keys locate the first notch by using either the tips of the key blank blade or a specially provided notch located near the blade tip as the reference point).

FIG. 1C shows a detail of the pin seat, PS, of a single notch shown circled in FIG. 1B; the width, W, of the pin seat, PS, is standarized on most keys to one of two values, either 0.040 inches ±0.005 inches or 0.090 inches ±0.005 inches. For reasons which will be discussed later, the width, W, of the pin seat cut by the apparatus disclosed herein is made 0.010 inches larger, i.e., 0.005 inches larger on each side of the center line CL of the pin seat, PS. This slight enlargement does not deleteriously affect the operability of a completed key because the pin seat must only be wide enough to accomodate the tumbler pin of the lock. Conceptually the pin seat could be any arbitrary width so long as it does accommodate the tumbler pin. However, a restriction on pin seat width comes about because the notches are usually closely spaced together. By an inspection of FIGS. 1A and 1C it should be apparent that the pin seat width, the notch depth and the slope angle of the notch are all inter-related. Key manufacturers are well aware of these inter-relationships and typically strive to designate compatable values for pin seat width, notch depth and slope angle so as to minimize deleterious interference between adjacent notches. (For example, the slope of one notch should not interfere with the slope of an adjacent notch and more importantly the slope of one notch should not interfere with an adjacent zero cut notch, i.e. a notch having no depth or one that is purposely not cut).

No standard generally used, single valued slope angle specification is known to exist in the locksmithing trade, but a slope angle of 45° appears to be an industry average. Hence the cutter of this apparatus is preferrably constructed to cut a notch having a 45° slope angle, i.e. the included angle defined by the slopes of a notch is preferrably 90°. Through expermentation it has been determined that a 45° slope angle creates no known deleterious effects between adjacent notches regardless of notch depth and regardless of increasing the pin seat width by 0.010 inches.

The pin seat is deliberately made 0.010 inches wider than normal to allow for positioning errors created by the accumulative effect of the tolerances necessarily built into the various parts of the machine and also to allow for the largest expected positioning error, that created by the operator of the apparatus when he sights and sets the various dials and scales associated with the apparatus. (It should be noted that is not absolutely necessary to increase pin seat width but it is practical to do so to allow for operator error).

It will be made clear from the following description that the code cutting machine of this invention accurately cuts with acceptable tolerance a wide variety of keys having widely differing codes. This object is accomplished, in part, by means of unique interaction among a carriage assembly, a key blank clamp assembly, a positioning means, an index arm, and a variable spacing control assembly.

Figure 2:
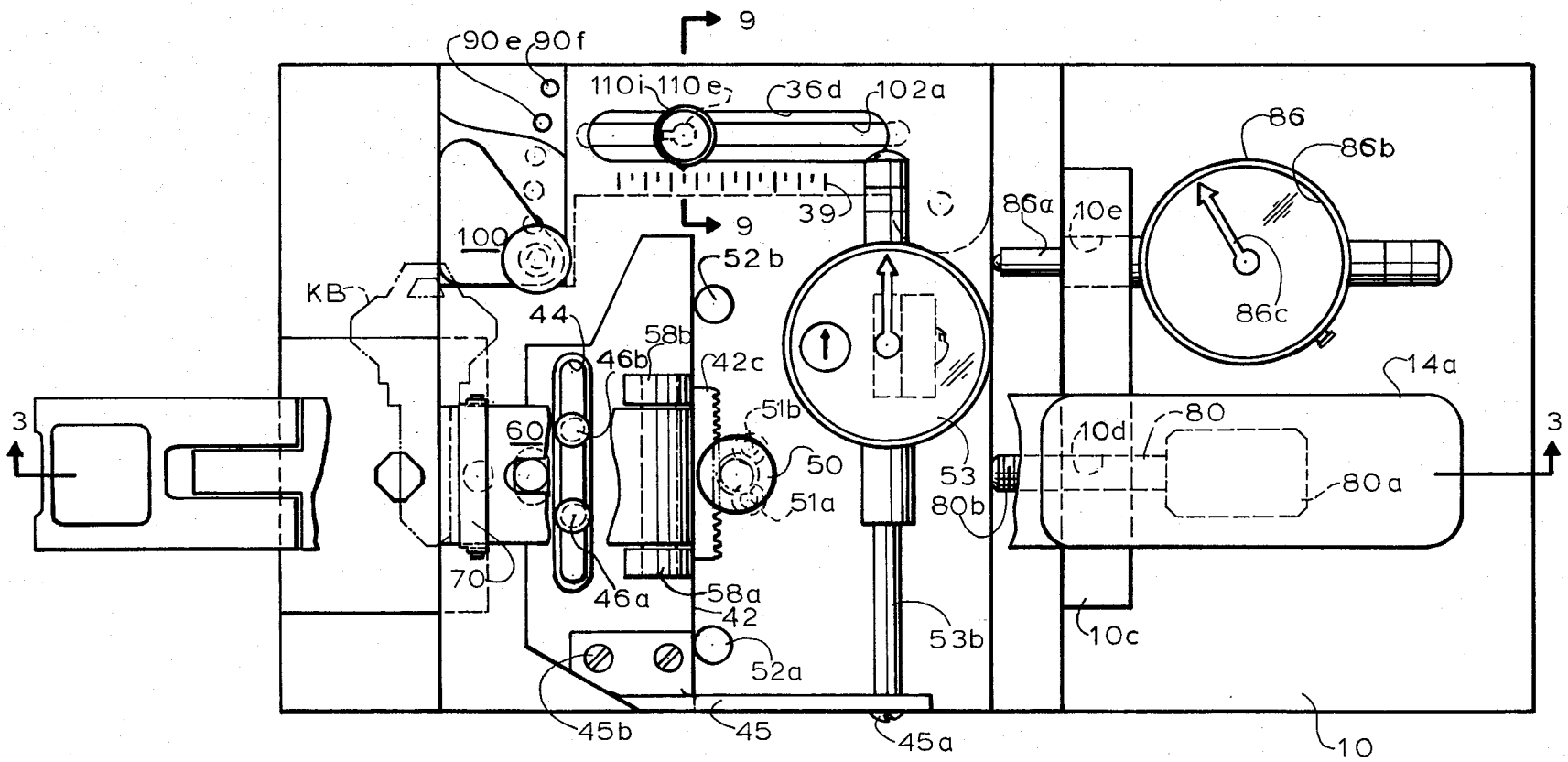
FIG. 2 is a top plan view illustrating apparatus constructed according to the present invention, a cutter and part of a cutter operating handle being broken away to more clearly show underlying structure.
Figure 3:
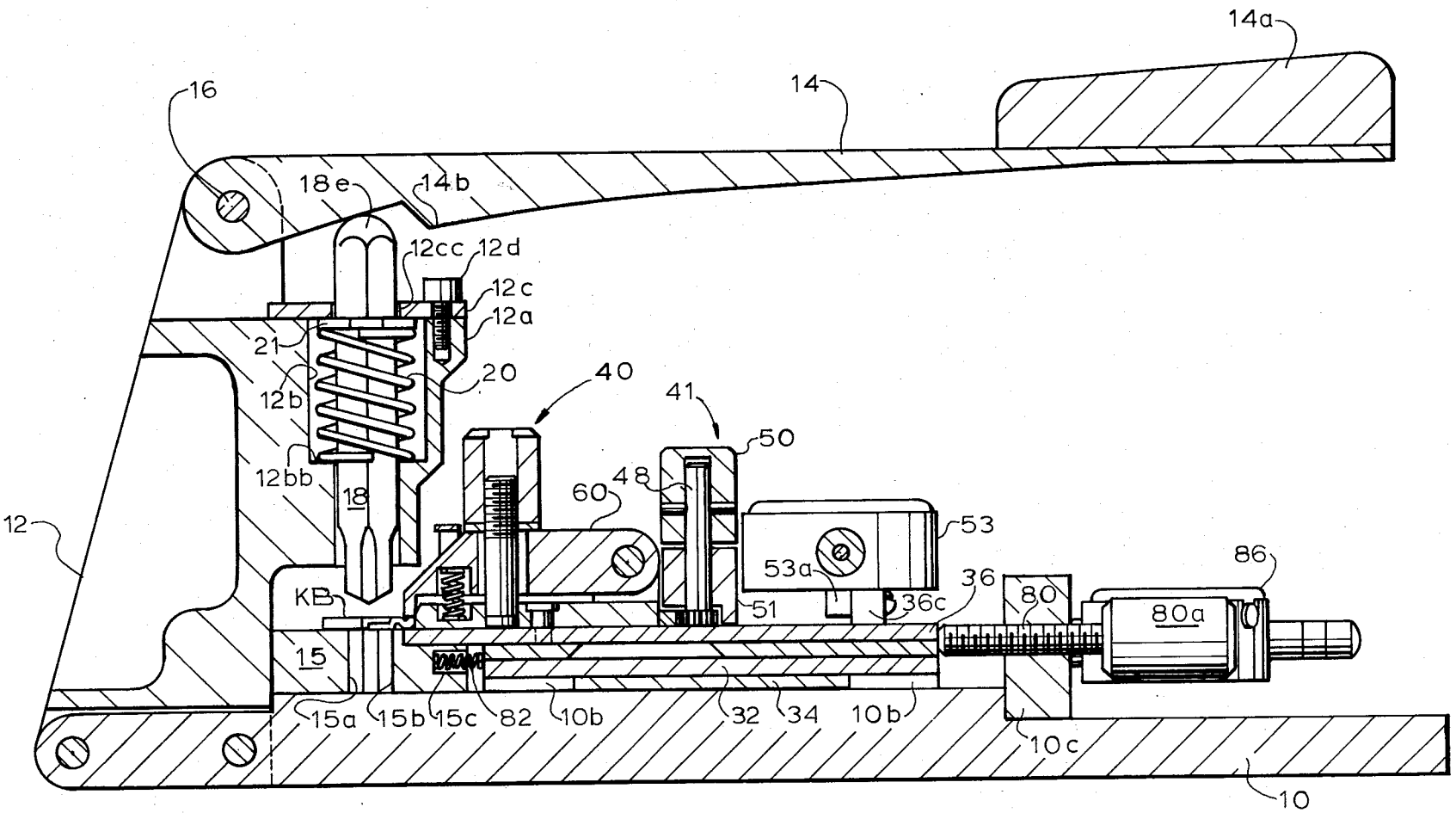
FIG. 3 is a sectioned side elevational view of the apparatus illustrated in FIG. 2, viewed from section line 3—3.
Figure 3A:
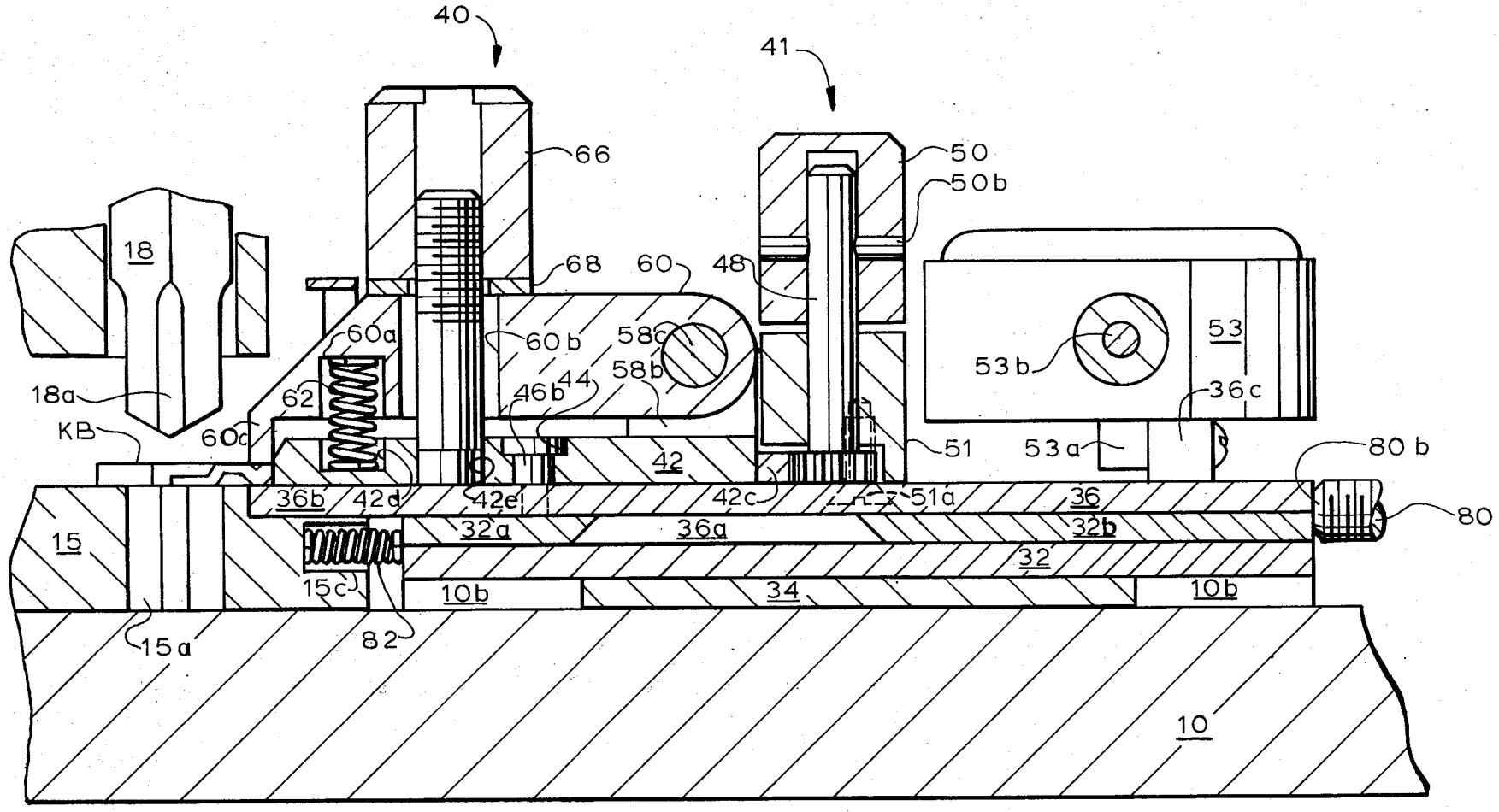
FIG. 3A is an enlarged sectional side elevational view of part of the apparatus shown in FIG. 3 which better illustrates a key blank clamping assembly and a key blank positioning means.

Referring to FIGS. 2, 3 and 3A, apparatus constructed according to the present invention is mounted on a base 10 and includes a cutter stand 12 removably secured to a projection of the base with pins **13*a*, 13*b*. A cutter arm 14 is pivotally connected to the upper portion of the cutter stand 12 with a pivot pin 16 or other suitable means. The cutter stand 12 includes an extension 12*a* which movably retains an elongated cutter 18 having a substantially square cross section along most of its length. The cutter stand extension 12*a* is provided with a shouldered bore 12*b* therethrough. The upper portion of the bore 12*b* accomodates the upper portion of the cutter 18 and a cutter return spring 20; the smaller, lower portion of the bore 12*b* has a square cross section which complements the cross sectional shape of the cutter 18 to thereby register with and guide the lower portion of the cutter 18**. (For clarity of presentation these elements are shown spaced further apart than would be the case in practice).

The lower end of the cutter may be provided with four cutting faces **18*a*. Each of the cutting faces 18*a* can be shaped to cut any desired notch profile. However, in practice, only one kind of notch profile, that shown in FIG. 1C, is required. Two cutting faces 18*a* are designed to cut the notch profile shown in FIG. 1C, the only difference between them being the width of the pin seat, PS, i.e. one cutting face 18*a* cuts a pin seat, PS, having a width of 0.040 inches plus 0.010 inches or 0.050 inches (±0.005 inches tolerance) and the other cutting face 18*a* cuts a pin seat, PS, having a width of 0.090 inches plus 0.010 inches or 0.100 inches (±0.005 inches tolerance). The cutter 18** is preferrably made from hardened tool steel.

The lower end of the cutter return spring 20 abuts the shoulder **12*bb* of the bore 12*b* and the upper end of the cutter return spring 20 abuts a slotted clip 21. The clip 21 is keyed to a reduced diameter portion of the cutter 18 to facilitate the action of the spring 20 in normally urging the cutter 18** upward to the position shown in FIG. 3.

An upper guide plate **12*c*, having a substantially square hole 12*cc* therethrough, is secured to the cutter stand extension 12*a* on one side with two threaded bolts 12*d*. The other side of the guide plate 12*c* is lodged in a recess in the cutter stand 12. This arrangement facilitates removal of the cutter from the cutter stand when it is necessary to confront a different cutter face 18*a*** with the key blank.

Since the cross sectional shapes of the upper guide plate **12*c* and the lower portion of the shouldered bore 12*b* are complimentary to the square cross sectional shape of the cutter 18, the cutter 18 is constrained to move in a plane perpendicular to the base 10 and each of the four cutting faces 18*a* located on the lower portion of the cutter 18 can each be selectively and precisely registered with respect to the key blank KB to thereby confront a selected one of the cutting faces 18*a* with a key blank. The upper end of the cutter 18 is provided with a land 18*e* which normally engages the underside of the cutter arm 14**.

In operation, the used exerts downwardly directed force on a pad 14a secured to the distal end of the cutter arm 14 to thereby depress the cutter 18 which shear cuts the key blank, KB. After a notch has been cut in the key blank, KB, the user releases the cutter arm 14 which allows the cutter return spring 20 to return the cutter 18 to its normal position shown in FIG. 3. Downward movement of the cutter 18 is limited by a boss 14b on the underside of the cutter arm 14 which ultimately engages the upper guide plate 12c on the downswing.

An anvil 15 having a cavity 15a therein is located beneath the cutter 18 and is secured to the base 10. The anvil is preferrably made of tool steel or the like. The height of the anvil 15 is made slightly less than the height of the carriage assembly 30 (see FIG. 4) to prevent binding between the anvil lip 15b and a key blank KB that is clamped to an extension 36b of the longitudinal carriage 36. The lip 15b of the anvil 15 also acts as a stop to prevent over-travel of the carriage assembly 30 toward the cutter. The anvil 15 acts as a supporting surface for the clamped key blank KB during the cutting operation. The material removed from the key blank KB drops into the bottom of the anvil cavity 15a and is periodically removed.

Figures 2A, 2B:
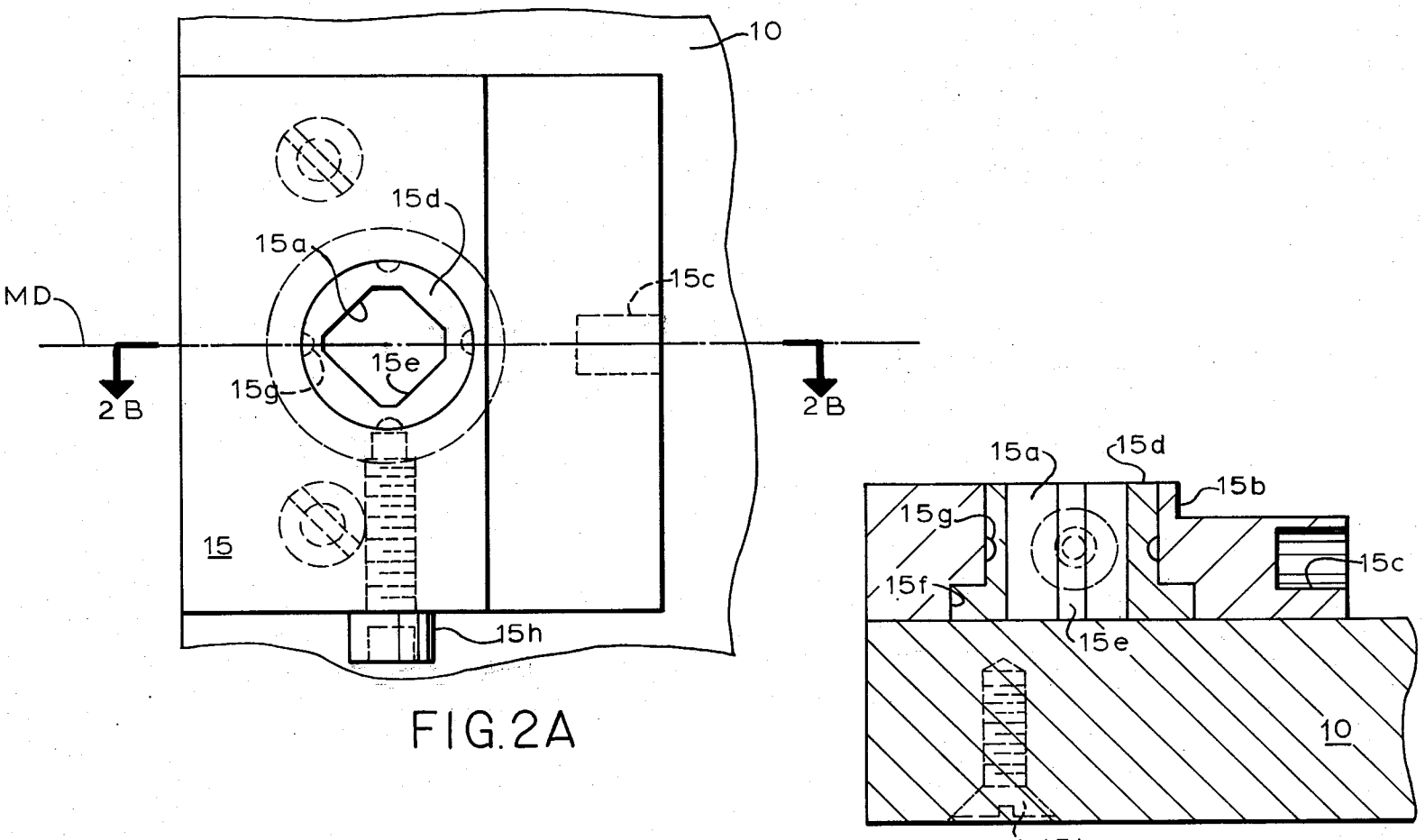
FIGS. 2A and 2B are enlarged detailed views of an anvil which is part of the apparatus shown in FIG. 2.

For clarity of presentation and to avoid confusion in FIGS. 2, 3 and 3A, further explanation of the anvil 15 will be made with reference to FIGS. 2A and 2B. To prevent excessive burring of the notches or bittings and to prevent distortion of the blade, BL, during the shear cutting operation, the anvil cavity 15a cross sectional shape is made complementary to the shape of the lower portion of the cutter 18 and the cutting faces 18a. The anvil cavity 15a is slightly larger than the lower portion of the cutter 18 to allow a slip fit. A complementary slip fit with the different sized cutting faces 18a is achieved by providing that the anvil cavity 15a be formed from a bushing 15d which reposes within the anvil 15 proper and which is arranged to be rotatable therein so as to register any one of four flats 15e with machine datum. Each of the four flats 15e complements a respective one of the four cutting faces 18a.

Rotation of the shouldered cylindrically shaped bushing 15d is accomplished by providing the anvil 15 with a countersunk bore 15f in which the bushing 15d reposes. Orientation of a particular one of the four flats 15e with machine datum MD is accomplished by providing the outer surface of the bushing 15d with four substantially spherical indentations 15g. A set screw 15h having a substantially spherical end cooperates with a selected one of the indentations 15g to lock the bushing 15d in place. The axis of the set screw 15h is oriented 90° with respect to machine datum, MD, to assure registration of the centerline of a selected one of the flats 15e with machine datum, MD.

The key cutting apparatus of this invention is provided with additional means for positioning a key blank to effect cutting of the first notch, for securely clamping a key blank KB to prevent movement of the blank during the shear cutting operation, for moving the clamped key blank longitudinally across the face of the cutter at preselected equal linear intervals to effect cutting of the remaining equally spaced notches, and for moving the clamped key blank transversly with respect to the cutter to thereby control the depth of the notches to be cut.

THE CARRIAGE ASSEMBLY

Figure 4:
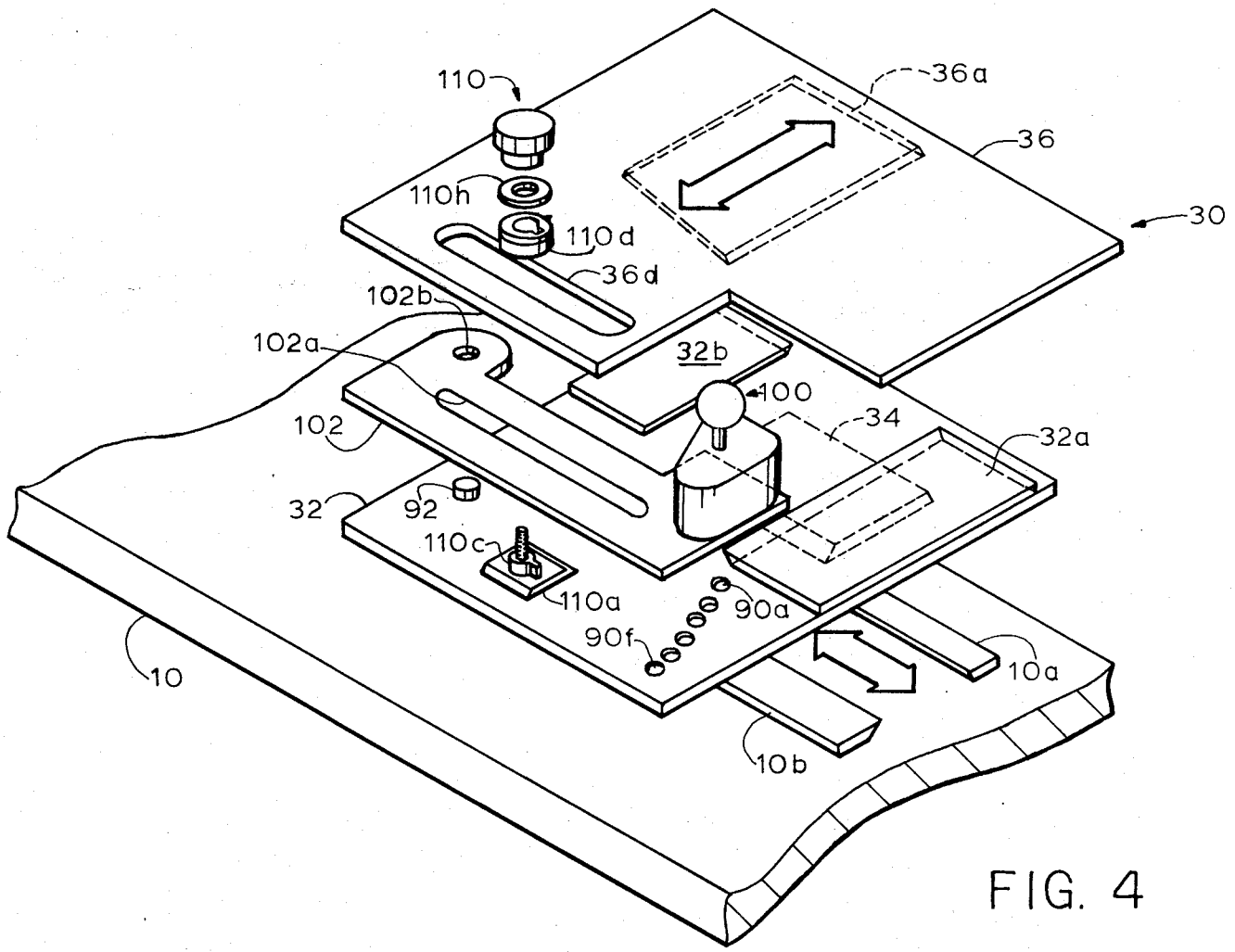
FIG. 4 is an exploded isometric view of a carriage assembly, a variable spacing control assembly, an index pin assembly, an index arm, and a base which are shown in this manner to better illustrate some of the more important cooperating elements of the apparatus illustrated in FIGS. 2 and 3.

The carriage assembly, generally designated by the numeral 30 in FIG. 4, provides the means by which a clamped key blank KB is moved toward and away from the cutter 18, i.e., a transverse motion, and the means by which the key blank KB is moved across the face of the cutter 18, i.e., a longitudinal motion, at equally spaced increments the lengths of which are determined by means of an extremely simple adjustment to a variable spacing control assembly 110.

Referring to FIGS. 2, 3, 4, 10 and 11, the carriage assembly 30 includes a substantially rectangularly shaped lateral carriage 32 provided with a beveled guide plate 34 depending therefrom. The guide plate 34 is slidable along a way formed by two beveled uprights 10a, 10b secured to the base 10. As best seen in FIG. 4, the lateral carriage guide plate 34 and the base uprights 10a, 10b are so oriented that the lateral carriage is constrained to move only transversely with respect to the cutter 18, i.e., only toward and away from the cutter 18 or leftwardly and rightwardly as viewed in FIGS. 2 and 3.

The carriage assembly 30 further includes a substantially rectangularly shaped longitudinal carriage 36. The underside of the longitudinal carriage 36 is provided with a beveled guide plate 36a which cooperates with two beveled uprights 32a, 32b secured to the upper side of the lateral carriage 32. However, as is clear from an inspection of FIG. 4, the longitudinal carriage 36 is carried by the lateral carriage 32 and hence these two carriages move as a unit toward and away from the cutter 18, but the longitudinal carriage 36 can slidably move independently of the lateral carriage in a perpendicular direction because of the crossed orientation of the guide 36a and uprights 32a, 32b with respect to the base uprights 10a, 10b. (Each of the respective guide plates and uprights are secured to their associated supports with screws or other suitable means). The dimensions and placements of the guides and uprights should be such that rectilinear motion of the lateral and longitudinal carriages is assured and any rotational movement is precluded.

KEY BLANK CLAMPING ASSEMBLY AND POSITIONING MEANS

Referring to FIGS. 2, 3, 3A and 5, the apparatus is provided with a key blank clamping assembly, generally designated 40, which holds the key blank KB immobilized for the cutting operation. The key blank clamping assembly 40 cooperates with a positioning means, generally designated 41, which permits the operator to accurately position the key blank KB with respect to the cutter 18 so that the portion of the key blade BL where the first notch, A, is to be cut is confronted with or placed under the cutter 18.

Figure 16:
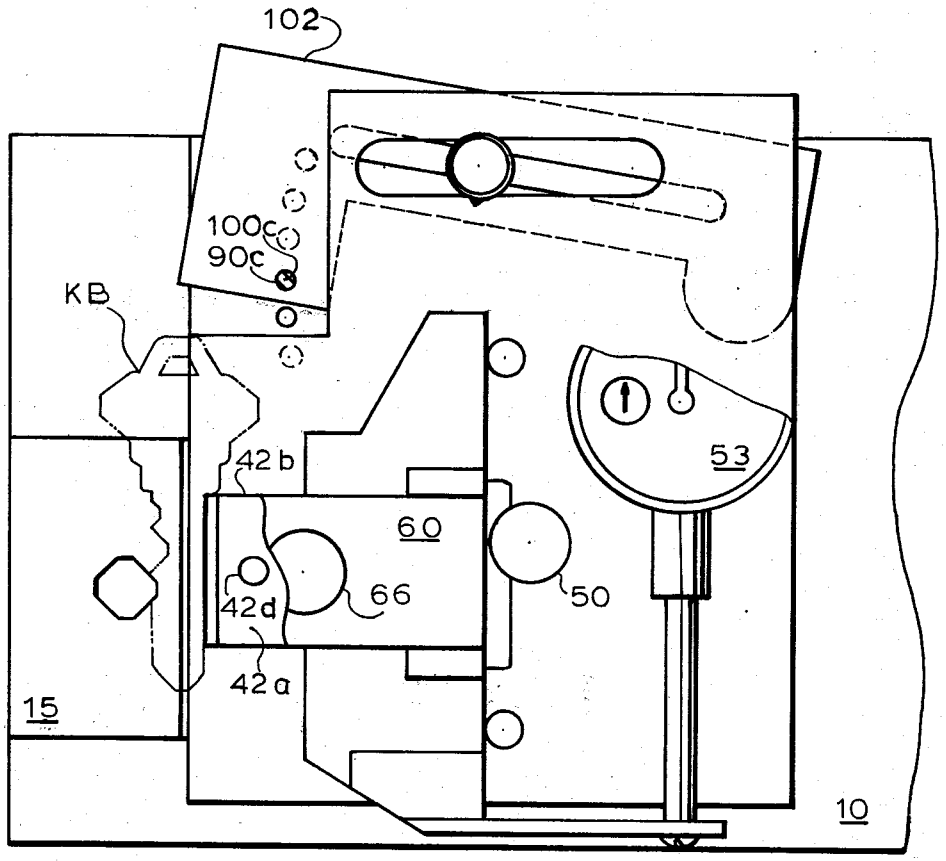
FIG. 16 is a fragmented top plan view of part of the apparatus shown in FIG. 2 illustrating the inter-related movement of various elements during operation of the apparatus.

The key blank clamping assembly 40 includes a movable shoulder locator table 42 provided with an elongated shouldered slot 44. The shouldered slot 44 acts as a guide and cooperates with two T-shaped posts 46a, 46b pressfitted or otherwise secured to the longitudinal carriage 36; the slot 44 and posts 46a, 46b assume a rectilinear sliding motion of the table 42. The forward portion of the table 42 underlies and is co-extensive with a clamp 60. For convenient reference the forward portion of the table 42 is called the table tongue 42a. The table tongue 42a is best seen in FIG. 16; it is purposely made one inch in width to facilitate easy measurement of the first cut distance. Either side wall 42b of the table tongue 42a serves as an abutment for the shoulder, S, of a key blank.

As best seen in FIGS. 2 and 3A the aft portion of the table 42 is provided with a rack 42c which cooperates with a pinion spindle 48. The pinion spindle 48 is controlled by a positioning knob 50 which is secured to the pinion spindle 48 with a split pin 50b. The pinion spindle 48 is journaled for rotation in a bushing 51 secured to the longitudinal carriage with two flat head screws 51a, 51b or other suitable means.

Over travel of the table 42 is prevented by limit pins 52a, 52b which are located on either side of the rack 42c and which are press fitted or otherwise secured to the longitudinal carriage 36. The limit pins 52a, 52b also prevent rotational movement of the table 42.

The rack 42c and the pinion spindle 48 are geared to move the table 42 in increments of at least one thousandths of an inch. A suitable rack and pinion may be purchased from PIC at Benrus Center, Ridgefield, CT. 06877. An anti-backlash arrangement is preferred but not necessary.

Measurement of the distance the table 42 has moved (when the positioning knob 50 is rotated by the operator) is accomplished with a commonly available dial indicator 53 provided with a standard downwardly depending lug-back 53a. The dial indicator 53 preferably records a minimum travel of one inch with a larger outer scale indicating in one-thousand inch (0.001) increments and a smaller inner scale reading in one tenth inch (0.100) increments. The dial indicator 53 is affixed to the aft of the longitudinal carriage 36 by bolting or otherwise securing the lug-back 53a to an upright 36c secured to the longitudinal carriage 36 by any suitable means, such as screws or bolts.

The reciprocating probe 53b of the dial indicator 53 is secured to one end of an aft directed indicator arm 45 with a bolt 45a or other suitable means. The other end of the indicator arm 45 is secured to the slidable movable table 42 with screws 45b or other suitable means. The indicator arm 45 transfers the motion of the table 42 to the dial indicator probe 53b to enable the dial indicator 53 to register the distance the table 42 is moved when the knob 50 is rotated by the operator.

Figure 5:
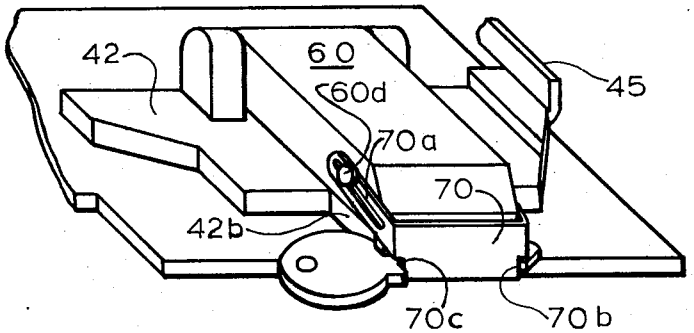
FIG. 5 is an isometric view of part of the apparatus illustrated in FIGS. 2 and 3 which highlights the operative position of an auxiliary shoulder locator.

Referring to FIGS. 2, 3A and 5, the aft upper side of the table 42 is provided with two spaced uprights 58a, 58b each having a bore therethrough which accomodates a shaft 58c. The shaft 58c movably supports a key blank clamp 60. A spring pocket 60a is provided in the forward portion of the clamp 60 and a complementary spring pocket 42d is provided in the forward portion of the table 42. The spring pockets 60a, 42d cooperate to house a normally uncompressed clamp return spring 62. Intermediate the spring pockets 60a, 42d and the table guide posts 46a, 46b, the table 42 and the clamp 60 are provided with concentric bores 42e, 60b, respectively, which accomodate an elongated T-shaped knob post 64. The lower end of the knob post 64 is immovably embedded in the table 42. The upper portion of the knob post 64 is threaded to accept a threaded clamping knob 66. A washer 68 provides a bearing surface between the clamping knob 66 and the upper side of the clamp 60.

As best viewed in FIGS. 2 and 3A, a double shouldered key blank KB, such as that shown in FIG. 1B is normally clamped along the length of the blade between a downwardly depending flange 60c of the clamp 60 and an extension 36b of the longitudinal carriage 36 which overlays the stepped anvil 15. The key blank KB is immobilized by tightening the clamping knob 66 which forces the clamp 60 downwardly and compresses the clamp return spring 62. Double shouldered keys, such as that shown in FIG. 1B, are positioned with respect to the key clamped assembly 40 by insuring that the shoulder, S, of the key blank abuts a side wall 42b of the tongue 42a of the movable table 42.

Single shouldered keys, such as that shown in FIG. 1A, cannot be indexed in this fashion since the shoulder is located on the side of the key blank where the notches are to be placed. To accomodate single shouldered key blanks, the key clamp assembly 40 is provided with an auxiliary shoulder locator 70, best seen in FIG. 5. The auxiliary shoulder locator 70 is provided with slots 70a which cooperates with two pins 60d, one of which is located on either side wall of the forward portion of the clamp 60 to thereby pivotally and slidably secure the auxiliary shoulder locator 70 to the clamp 60. That portion of the locator 70 which is designed to contact the key blank shoulder, S, is undercut, as at 70b and 70c, to insure alignment of the shoulder with either side wall 42b of the tongue 42a of the movable table 42, depending upon the side from which the key blank is loaded into the clamp 60.

Alignment of the single shouldered key is accomplished by swinging the locator 70 downwardly and abutting the shoulder, S, with either undercut portion 70b or 70c of the locator 70 which is equivalent to abutting one of the shoulders, S, of a double shouldered key with a side wall 42b of the tongue 42a the table 42. After the key blank is clamped, the locator 70 is swung upwardly and rearwardly to its storage position, best seen in FIG. 2. In the storage position, the auxiliary shoulder locator 70 does not interfere with the cutting operation.

The key clamp assembly 40 and positioning means 41 operate as follows. For any particular key blank KB to be cut, the operator first determines from the code books the distance along the length of the key blade at which the center line, CL, of the first notch is to be located; this first cut distance (such as S-A in FIG. 1A) is measured from a reference point on the key blank which is usually the shoulder, S, of the key blank KB. After ascertaining the first cut distance, the operator turns the positioning knob 50 until the dial indicator 53 reads the proper value on its scale. Since the positioning knob 50 is secured to the pinion 48, and the pinion 48 is meshed with the rack 42c, turning the positioning knob 50 causes the table 42 to move the required linear distance from the machine datum line, i.e. the cutter face 18a center line, and, of course, the center line of the anvil cavity 15a.

The center line of the shoulder locator table 42 is normally aligned with machine datum when the index arm is in its neutral position, that is, when the index pin is registered with the index hole closest to the cutter. (When the index arm is in its neutral position, the carriage assembly assumes the aligned aspect shown in FIG. 2). The embodiment shown in FIGS. 2 and 3, the forward portion of the table 42, i.e., the table tongue 42a, is one inch in width; hence one half of the table tongue 42a lies on either side of machine datum and the dial indicator 53 reads 0.500 inches. (If this reading is not achieved with the index arm in the neutral position, the center line of the table 42 is not aligned with machine datum but must be made so by rotating the positioning knob 50 until the dial indicator reads 0.500 inches).

The first cut distance is established by moving the table 42 while accounting for the half width (0.500 inches) of the table tongue 42a. For example, if the code books specify a first cut distance of 0.200 inches for a particular key, the table 42 is moved until the dial indicator 53 indicates a table 42 movement of 0.300 inches. The difference between these two indications is 0.200 inches; hence, the shoulder of the key blank is located precisely 0.200 inches from machine datum. (This concept is clear, if it is remembered that when a key blank shoulder abuts either side wall **42*b* of the table tongue 42*a*, that the distance between the shoulder and the center line of the table 42** is exactly 0.500 inches).

After the key blank clamp assembly 40 has been moved the required first cut distance, SA, the key blank, KB, is inserted between the depending flange **60*c* of the clamp 60 and the extension 36*b* of the longitudinal carriage 36 with the shoulder, S, of the key blank abutting either side wall 42*b* of the table tongue 42*a* or either undercut 70*b*, 70*c* of the auxiliary shoulder locator 70 depending upon from which side of the clamp 60 the blank is loaded. The key blank KB is then clamped and made immobile with respect to the longitudinal carriage 36 by tightening the clamping knob 66**.

After clamping the key blank KB is this fashion, the first notch, A, can be cut after the code books have been consulted to determine the proper notch depth, *d*, and after the carriage assembly 30 has been adjusted to effect the required notch depth, *d*. After the first cut is made, the remaining equally spaced notches, B, C, D, and E, may be cut.

Figure 14:
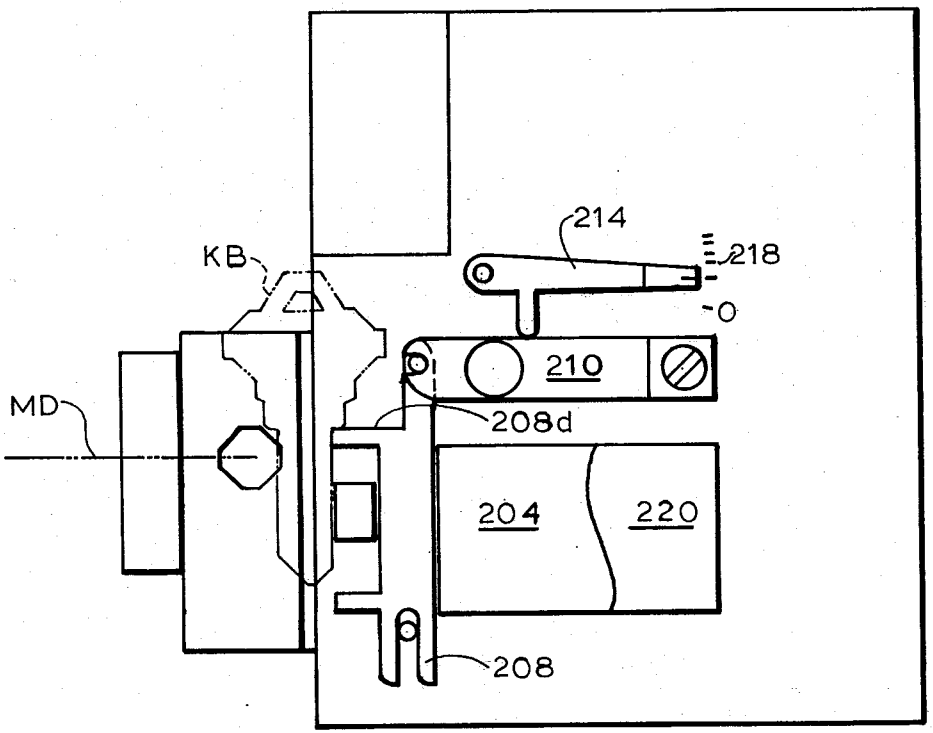
FIG. 14 is a view similar to FIG. 12 showing the key blank shoulder spaced from machine datum and in position for cutting of the first notch.
Figure 13:
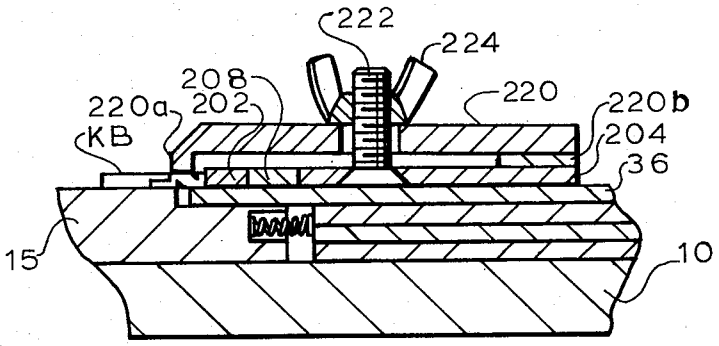
FIG. 13 is a sectioned side elevational view along the line 13—13 of the apparatus illustrated in FIG. 12.
Figure 12:
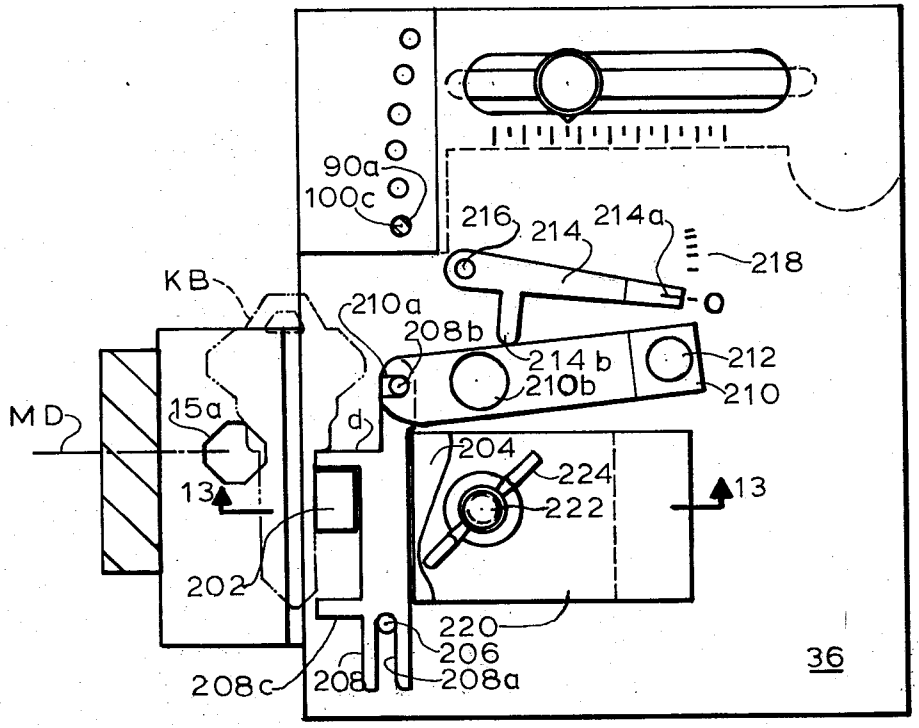
FIG. 12 illustrates a second embodiment of a key blank positioning means and key blank clamp showing a phantomed key blank shoulder in alignment with machine datum.

An alternative key blank clamp and shoulder locator assembly is shown in FIGS. 12, 13, and 14 which have been partially fragmented and sectioned to more clearly illustrate important structures.

Two guide plates 202, 204 and one upstanding guide pin 206 are secured to the upper surface of the longitudinal carriage 36. A slide link 208 is constrained to move reciprocally between the guide plates 202, 204 in a rectilinear manner, (For clarity of presentation, the guide plates 202, 204 and the slide link 208 are shown with more spacing between them in FIGS. 12 and 14 than would be the case in actual practice).

One end of the slide link 208 is provided with an open ended slot **208*a* which slidably receives the upstanding guide pin 206. The other end of the slide link 208 is provided with an upstanding lug 208*b*. Intermediate the ends of the slide link 208 two spaced projecting ears 208*c*, 208*d* are provided. Each ear 208*c*, 208*d* is rectangularly shaped. The key blank shoulder, S, normally abuts the ear 208*d***.

An elongated drive link 210 is also provided. One end of the drive link 210 is rotatably mounted on a upstanding pivot pin 212. The pivot pin 212 is secured to the longitudinal carriage 36; its upper end is capped or swaged to prevent dislodgment of the drive link 210. The other end of the drive link 210 is provided with an open ended slot **210*a* which receives the lug 208*b* on the slide link 208. The lug 208*b* and the slot 210*a* cooperate to transfer motion between the slide link 208 which moves in a rectilinear manner and the drive link 210 which moves in an arcuate manner. Intermediate the ends of the drive link 210, a knob 210*b* is provided; the knob 210*b*** facilitates operator setting of the first cut distance.

An elongated indicator link 214 is also provided. One end of the indicator link 214 is rotatably mounted on an upstanding pivot pin 216. The pivot pin 216 is secured to the longitudinal carriage 36; its upper end is capped or swaged to prevent dislodgment of the indicator link 214. The other end of the indicator link 214 is narrower and is provided with a hash mark **214*a*. The hash mark 214*a* cooperates with an arcuate setting scale 218, located on the upper surface of the longitudinal carriage 36, to indicate the first cut distance, i.e., the distance from a reference point on the key blank, usually the shoulder, to the pin seat center line of the first notch. Intermediate the ends of the indicator link 214 an elongated boss 214*b* is provided. The boss 214*b* normally engages the drive link 210 to transfer motion between the arcuately movable drive link 210 and the arcuately movable indicator link 214**.

The arcuate setting scale 218 is engraved or otherwise placed on the upper surface of the longitudinal carriage 36. It is marked in any convenient increments to allow the operator to read or interpolate the distance through which the slide link 208 must be moved to establish a desired first cut distance.

After the first cut distance has been established, the key blank is secured to the longitudinal carriage with a clamp 220, best seen in FIG. 13. An upstanding threaded clamping post 222 is secured to the guide plate 204; the post 222 accepts a threaded clamp nut 224.

Overlaying the guide plate 204 and spaced therefrom is the clamp 220. The forward portion of the clamp 220 has a downwardly depending flange **220*a* which normally engages the blade of the key blank along most of its length. The aft portion of the clamp 220 also has a downwardly depending flange 220*b* which normally engages the aft portion of the guide plate 204. After a key blank KB has been properly positioned for the first cut, the clamp 220 is overlayed the guide plate 204 and the clamp nut 224 is tightened snugly; the forward clamp flange 220*a* then snugly engages the blade of the key blank and clamps the key blank to the longitudinal carriage 36**.

In FIG. 12, the key blank shoulder, S, is shown positioned at machine datum, MD. This position is reached by ensuring that the index pin **100*c* is lodged in index hole 90*a* and by ensuring that the projecting ear 208*d* of the slide link 208 abuts the guide plate 202. With these precautions accomplished, the slide link 208, drive link 210 and indicator link 214 assume the positions shown in FIG. 12 and the hash mark 214*a* points to the zero mark on the setting scale 218**.

To establish the first cut distance, the operator consults the code books and ascertains the value for the particular key to be cut. The operator then moves the slide link 208 until the hash mark **214*a* indicates this value on the setting scale 218. As best seen in FIG. 14**, the key blank is now located at the proper position for the first cut to be made. After the key blank is clamped and the depth adjustment is made, the first cut can be effected.

Before further explanation of the operation of the code key cutting apparatus is made, a more detailed description is required of those portions of the apparatus which effect notch depth control (transverse motion) and incremental motion of the key blade across the face of the cutter (longitudinal motion). The means for effecting motion of the lateral and longitudinal carriages is described below.

TRANSVERSE MOTION

Referring to FIGS. 2, 3 and 4, to effect transverse motion of the carriage assembly 30, the base 10 is provided with an upright **10*c* having a bore 10*d* therethrough which threadably receives a depth control shaft 80. The shaft 80 is provided at one end with a depth control knob 80*a*** and at the other end with a flat 80*b* which normally engages the longitudinal carriage 36. Turning the knob 80*a* clockwise causes the shaft 80 to push against the longitudinal carriage 36. Since the longitudinal and lateral carriages are constrained by the guide plate 36*a*and the uprights 32*a*, 32*b* to move as a unit in the transverse direction, the entire carriage assembly 30 moves to the left, i.e., toward the cutter as viewed in FIGS. 2 and 3. Movement of the carriage assembly 30 away from the cutter 18 is accomplished by turning the knob 80*a* counterclockwise. A carriage assembly 30 return spring 82 having one end lodged in a spring pocket 15*c* provided in the anvil 15 and the other end engaging a forward edge of the carriage assembly 30 is arranged to apply rightwardly directed force against the carriage assembly 30 as viewed in FIGS. 2 and 3. (It should be noted here that the longitudinal carriage 36 is in abutment with the anvil lip 15*b* in the views of the apparatus set forth in FIGS. 2 and 3. Hence further movement of the carriage assembly 30 toward the cutter is not possible).

The extent to which the carriage assembly 30 moves toward the cutter 18 is measured by a depth reading dial indicator 86 which is also supported by the base upright 10*c* by means of a second bore 10*e* therethrough. The probe 86*a* of the dial indicator abuts the aft edge of the carriage assembly 30. Any commercially available dial indicator 86 may be employed so long as it registers a range as least as large as 0.001 inches to 0.250 inches to accomodate the comparatively wide range of transverse motion required of the carriage assembly 30.

Accurate depth measurement is achieved by "zeroing" the dial indicator 86 in the following manner. After the key blank KB is clamped, the carriage assembly 30 is moved toward the cutter 18 until the key blank blade, BL, abuts the depressed cutter 18. The dial 86*b* of the dial indicator 86 is then rotated to bring the dial pointer 86*c* and dial scale zero mark into alignment. Hence zeroing is achieved.

After the cutter 18 is raised, the depth of the first notch to be cut is read from the appropriate code book and the depth control knob 80*a* is turned until the dial indicator 86 shows correspondence with the chart value. A notch of proper depth, *d*, may then be cut by depressing the cutter 18 as hereinbefore explained. (As will be explained below, before making the first cut, the operator should also ascertain that the index pin 100*c* (FIG. 7) reposes in the proper index hole, either 90*a* or 90*f*, depending upon the side from which the key blank, KB, is loaded).

LONGITUDINAL MOTION

Longitudinal motion of the longitudinal carriage 36 is accomplished in such manner that the blade, BL, of the key blank is precisely indexed at machine datum at equally spaced intervals which correspond to the required center-to-center distance between notches. Since different keys require different center-to-center dimensions between the notches, the carriage assembly 30 also carries a variable spacing control assembly 110 which allows the operator to preset a wide variety of center-to-center dimensions through which the longitudinal carriage 36 must move in step-like fashion.

Referring to FIGS. 2 and 4, the indexing and variable spacing functions are achieved as follows. The lateral carriage 32 is provided with six index holes 90*a, b, c, d, e, f,* which are spaced along an arc whose center is located at a pivot stub 92 secured to and raised from the lateral carriage 32. The index holes 90 register with an index pin assembly 100 secured to the forward end of an elongated indexing arm 102. The indexing arm 102 is provided with a slot 102*a* intermediate its ends. The aft end of the indexing arm 102 is provided with a hole 102*b* through a laterally extending rounded projection 102*c*. (See FIG. 6). The stub 92 normally reposes within the hole 102*b*; in this way the index arm 102 is pivotally mounted on the lateral carriage 32.

Another and wider elongated slot 36*d* is provided near one edge of the longitudinal carriage 36. The normally aligned indexing arm slot 102*a* and longitudinal carriage slot 36*d* accomodate a variable spacing control assembly 110 which is slidably movable along the length of both aligned slots 102*a*, 36*d* to positions selected by the operator.

Figure 8:
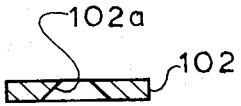
FIG. 8 is a cross section along the line 8—8 of the index arm illustrated in FIG. 6 that has been rotated 90° clockwise.
Figure 6:
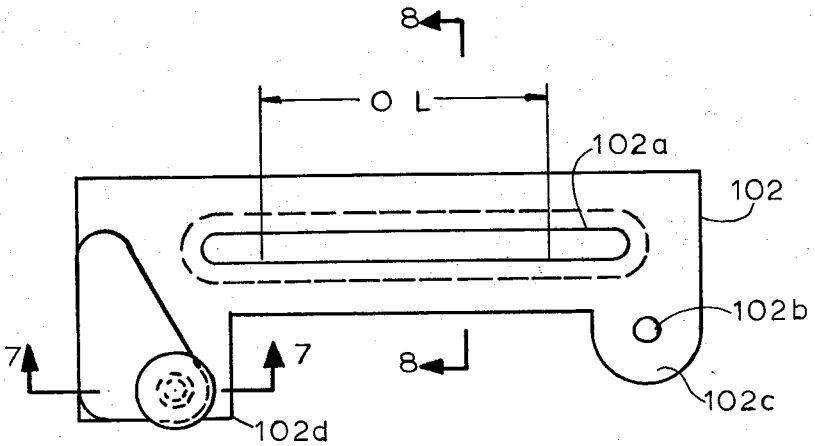
FIG. 6 is a top plan view illustrating an index arm and associated index pin assembly which are cooperating elements of the apparatus shown in FIGS. 2 and 3.
Figure 7:
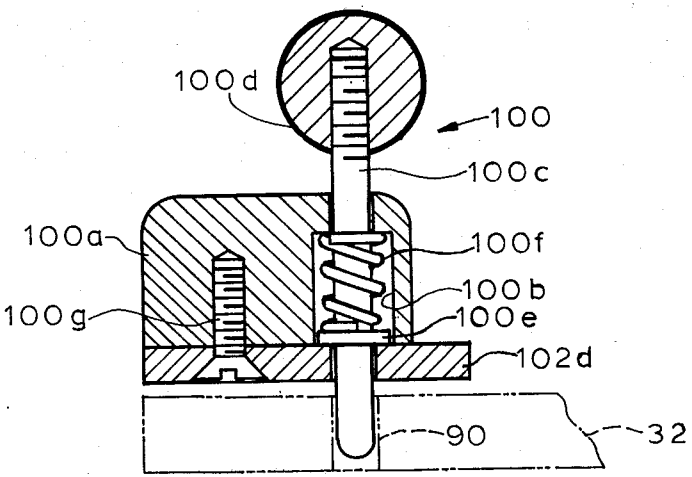
FIG. 7 is an enlarged sectional side elevational view of the index pin assembly taken along the lines 7—7 of FIG. 6.

FIGS. 6, 7 and 8 illustrate the index arm 102 and the index pin assembly 100 in more detail. The operative length, OL, of the index arm slot 102*a* is determined by the range of center-to-center values over which the apparatus is designed to operate. As best seen in FIG. 8, the index arm slot 102*a* has a trapezoidal cross section having an opening on the top surface of the index arm 102 that is smaller than the opening in the bottom surface of the index arm 102; this particular slot shape accomodates a portion of the variable spacing control assembly 110 as will be explained later.

Referring to FIGS. 6 and 7, the forward end of the index arm 102 is provided with a rectangular shaped laterally extending projection 102*d* which carries the index pin assembly 100. The index pin assembly 100 includes a housing 100*a* having a shouldered bore 100*b* therethrough. The bore 100*b* accomodates an index pin 100*c*; the upper end of the index pin 100*c* threadably receives a knob 100*d* while the lower end of the index pin 100*c* is slightly rounded to effect better registration with the index holes 90 provided in the lateral carriage 32. The index pin 100*c* is provided with a collar 100*e*. A spring 100*f*, the ends of which abut the shoulder of the bore 100*b* and the collar 100*e* normally urges the index pin 100*c* downwardly, as shown in FIG. 7. The biasing action of the spring 100*f* assures snug registration of the index pin 100*c* with an index hole 90. The housing 100*a* is secured to the rectangular index arm projection 102*d* by any suitable means such as with countersunk screws 100*g*. (The lateral carriage 32 and index hole 90*a* are shown in phantom and exaggerated to better illustrate the cooperation of the index pin 100*c* with the index holes 90).

Figure 9:
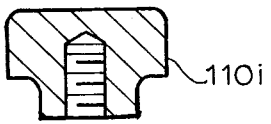
FIG. 9 is a sectioned and enlarged elevational view along the line 9—9 of the apparatus illustrated in FIG. 2, which gives a detailed view of a variable spacing control assembly.
Figure 9:
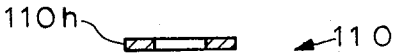
Figure 9:
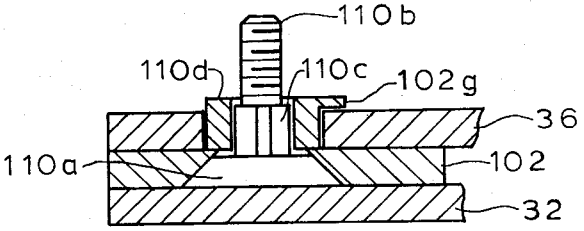

Referring to FIGS. 2, 4 and 9, the variable spacing control assembly 110 includes a beveled clamp 110*a* with a cross sectional shape complementary to the cross-sectional shape of the index arm slot 102*a* into which it fits and along which the clamp 110*a* must slide. The thickness of the clamp 110*a* is preferably less than the depth of the index arm slot 102*a* to facilitate this sliding motion and to insure a snug abutment with the walls of index arm slot 102*a* when the assembly 110 is tightened down at an index point selected by the operator.

Extending upwardly from the clamp 110*a* is a partially threaded post 110*b*. At the juncture of the post 110*b* and clamp 110*a* a direction oriented key 110*c* is provided. The clamp 110*a*, post 110*b* and key 110*c* act as a unit and preferably are made as one piece although they may be separately made and joined together so as to be immovable with respect to each other.

Overlaying the key 110*c* is a cylindrically shaped pusher 110*d* having a direction oriented keyway 110*e* therethrough. The keyway 110*e* registers with the protruding boss of the key 110*c* insuring that the pusher 110*d* does not rotate with respect to the key. The upper portion of the pusher 110*d* is provided with a radial extension 110*g* which acts as a pointer or indicating arm; the pointer 110*g* cooperates with a scale 39 on the longitudinal carriage 36 to indicate to the operator which center-to-center spacing is being selected. The keyway 110*e* and key 110*c* cooperate to insure that the pointer 110*g* points toward the scale 39. The pusher 110*d* is preferably made from a substantially non deforming material such as tool steel or the like.

The underside of the pusher 110*d* normally slides along the upper surface of the index arm within the confines of the wider slot 36*d* in the longitudinal carriage 36. To facilitate the sliding motion, the width of the pusher 110*d* is made slightly smaller than the width of the slot 36*d* in the longitudinal carriage. Since the pusher 110*d* is the element which ultimately pushes against the longitudinal carriage 36 to effect motion of the longitudinal carriage, the diameter of the pusher 110*d* is preferably no more than 0.003 inches less than the width of the slot 36*d* in the longitudinal carriage 36. In other words, the play or lost motion between the pusher 110*d* and the longitudinal carriage must be kept to a minimum to keep the rectilinear motion of the longitudinal carriage 36 within acceptable tolerance.

Any mis-positioning errors which may occur because of the lost motion associated with the clearance between the pusher 110*d* and the longitudinal carriage 36 (as well as the tolerances associated with the guides and other elements of the apparatus) can be compensated by enlarging the width of the pin seat of the notch cut by the cutter 18 as hereinbefore explained. Hence, any mis-positioning errors which may occur from the effects of accumulative tolerances and operator error can be adequately compensated.

With further reference to FIGS. 4 and 9, the remaining portions of the variable spacing control assembly 110 include a washer 110*h* overlaying the pusher 110*d*. The washer 110*h* acts as a bearing surface for an internally threaded knob 110*i* which mates with the threaded upper portion of the post 110*b*.

When the knob 110*i* is loosely threaded onto the post 110*b*, the entire variable spacing control assembly 110 can be slid along the length of the normally aligned carriage assembly slot 36*d* and index arm slot 102*a*. When the knob 110*i* is tightly threaded onto the post 110*b*, the entire variable spacing control assembly 110 is clamped to the index arm 102 and in effect becomes a part thereof, as best seen by an inspection of FIG. 9. The point along the length of the slots at which the variable spacing control assembly 110 is clamped is chosen by the operator to produce the desired center-to-center spacing for the particular key to be cut. The setting scale 39 indicates the range from which the selection may be made.

Once the variable spacing control assembly 110 is locked to the index arm 102, part of the motion of the pivotable index arm 102 is transferred to the longitudinal carriage 36 by means of the pusher 110*d* bearing against the side walls of the slot 36*d* in the longitudinal carriage 36.

The index arm 102 is pivoted about the stub 92 on the lateral carriage 32 by lifting the spring biased index pin 100*c* out of one of the index holes 90 in which it normally reposes. This action frees the index arm 102 and the operator may then rotate the index arm 102 either clockwise or counterclockwise about the stub 92 to effect registration of the index pin 100*c* with another index hole 90. As the index arm 102 is rotated, the pusher 110*d* bears against the longitudinal carriage 36 and imparts motion to it. However, the longitudinal carriage 36 is constrained by the guide plate 36*a* and the uprights 32*a*, 32*b* to move in a rectilinear fashion which is made possible by the scissoring effect of the slots 102*a*, 36*d* and the rigidness of the guide plate 36*a* and the uprights 32*a*, 32*b*.

Figure 15:
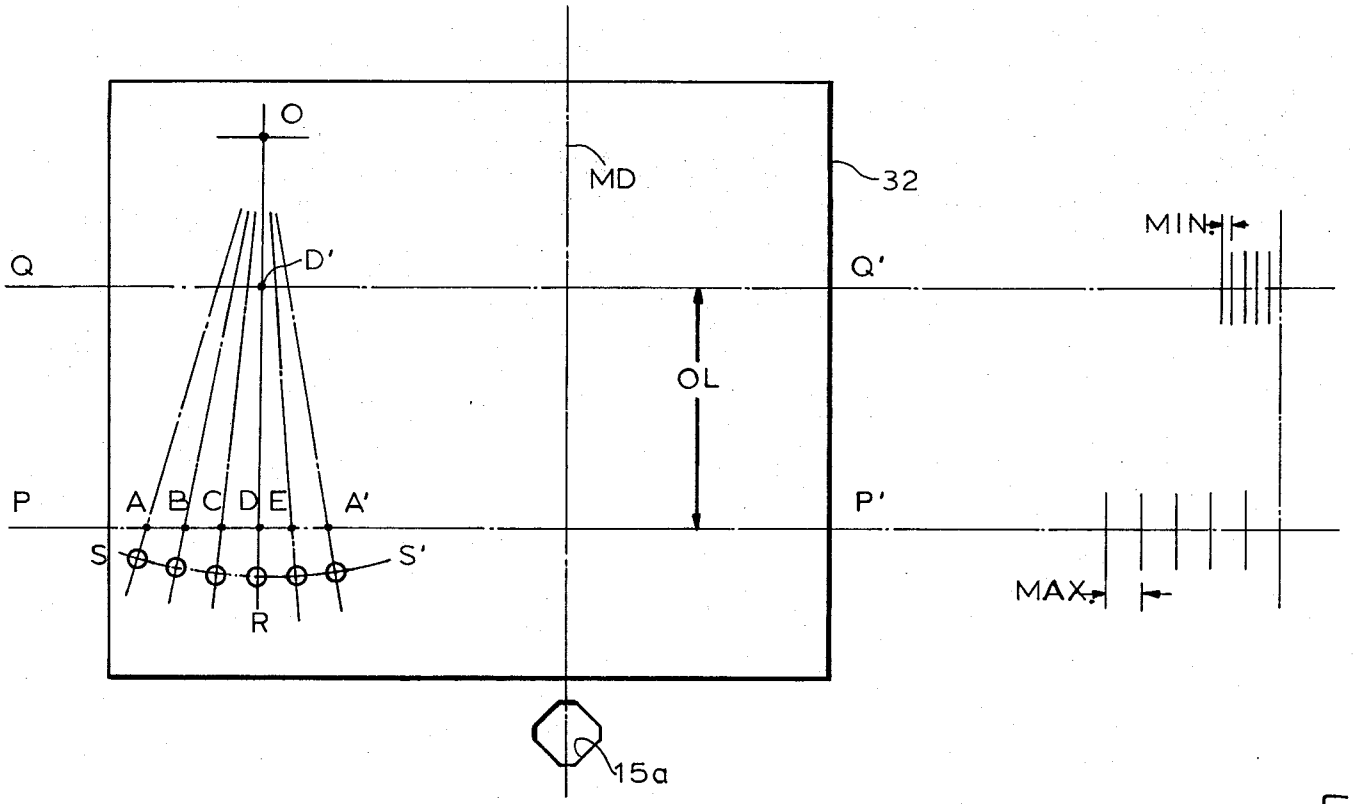
FIG. 15 illustrates the technique of incrementally moving the index arm assembly through an arc and transferring part of that motion into an incremental rectilinear motion of a longitudinal carriage.

FIG. 15 is a diagram which explains the technique of incrementally moving the index arm 102 through an arc and transferring part of that motion into an incremental rectilinear motion of the longitudinal carriage 36.

In FIG. 12 an outline of the lateral carriage 32 is shown and the index holes 90*a* to 90*f* are also shown. The preferred method of locating the index holes 90 entails the use of facts derived from the code books provided by lock makers. From a perusal of the code books one can deduce the minimum center-to-center distance between the center lines, CL, of the pin seats of the notches of a certain key and the maximum center-to-center distance between the notch pin seats for another and different key. The code books also reveal the number of notches which must be cut into the blade. With this knowledge the total minimum linear travel and the total maximum linear travel that is required of the longitudinal carriage can be calculated for keys which are presently known.

With the foregoing information at hand, one can reliably and accurately construct the index holes 90 in the lateral carriage 32 in the following manner. A base line radius, OR, of arbitrary length is extended from the point O along a line that is parallel to the machine datum, that is, the cutter face 18*a* and anvil cavity 15*a* center line. (Point O corresponds to the center of the pivot stub 92). Perpendicular to the base line radius, OR, a line PP′, is constructed. Beyond the intersection, D, of the line PP′ and the base line radius OR, an arc, SS′, of arbitrary length is constructed. The center of the arc, SS′, is the point O.

Starting at point D, three equal increments (D–C, C–B, and B–A) are marked on the line pp′ to the left of point D and two equal increments (D–E and E–A′) are marked on the line pp′ to right of point D. These equal increments correspond to the maximum expected center-to-center distances. (It should be noted here that the maximum and minimum values can be, and have been, increased and decreased, respectively, to allow for the making of keys not yet on the market).

Once the points A, B, C, D, E and A′ are located on the line PP′, additional radials are extended from the point O to these points and extended beyond them until the radials intersect the arc SS′. The intersections of the radials with the arc SS′ accurately locates the centers of the index holes 90.

A line, QQ′, parallel to the line PP′ defines the minimum expected center-to-center distances. The distance between the line PP′ and the line QQ′ defines the operative length OL, of the index arm slot and the extent of the scale markings.

When the variable spacing control assembly is clamped at a place corresponding to point D, maximum linear increments of 0.180 inches are generated by movement of the index arm. When the variable spacing control assembly is clamped at a place corresponding to point D′, minimum linear increments of 0.090 inches are generated. Intermediate values are generated by clamping the variable spacing control assembly at places along the index arm slot 102*a* corresponding to points intermediate the points D and D'. (For clarity of presentation, the maximum and minimum linear increments that the longitudinal carriage 36 undergoes are shown on extensions of the lines PP' and QQ', respectively.

It should be noted here that the index holes 90 could all be located on one or the other side of the base line radius, OR. However to allow for key loading from either side of the clamp and to minimize any binding that may occur between the pusher 110*d* and the longitudinal carriage 36, the index holes 90 are distributed with respect to the base line radius, OR, as shown in FIG. 15.

It should be clear from the foregoing that any number of index holes 90 can be constructed to accomodate keys having more than the commonly found five or six notches. It should also be clear that the size of the entire apparatus may be proportionately increased or decreased as desired without loss of the capability to perform the functions described herein.

OPERATION

Before a key blank is clamped and notches are cut into the blade of the key blank, code books provided by lock manufacturers are consulted to ascertain the required number of notches, the depth of each notch, the distance from a reference point on the key at which the pin seat center line of the first notch is located, the required pin seat width, and the required center-to-center, or inter-notch, distance.

With this information at hand, the apparatus is brought into its standard configuration as shown in FIG. 2. The standard configuration is achieved when the index arm 102 is in its neutral position, i.e. where the index pin 100*c* is lodged in the index hole 90*a* nearest the cutter and the slots 102*a*, 36*d* of the index arm 102 and longitudinal carriage 36 are in alignment. The shoulder locator table 42 center line is then aligned with machine datum by ensuring that the dial indicator 53 reads 0.500 inches. The first cut distance is established by rotating the positioning knob 50 until the required movement is indicated on the dial indicator 53. The key blank is then inserted beneath the clamp 60 with its shoulder abutting a side wall 42*b* of the shoulder locator table 42 or one of the undercuts 70*b*, 70*c* in the auxiliary shoulder locator 70 as explained before. The key blank is then clamped to the longitudinal carriage extension 36*b* by tightening the clamping knob 66. The carriage assembly 30 is backed away from the anvil 15 by turning the depth control knob 30*a* and the cutter 18 is lowered. The depth control knob 80*a* is then turned until the clamped key blank abuts the depressed cutter 18. This establishes the zero depth reference and the depth control dial indicator 86 is adjusted to reflect zero depth as explained before. The cutter 18 is raised and the depth control knob 80*a* is turned to move the carriage assembly 30 toward the cutter 18. The carriage assembly 30 is advanced until the depth control dial indicator 86 shows that the required notch depth has been achieved. The first notch is cut by depressing cutter arm 14.

After the first notch, A, has been cut the remaining notches may cut after the inter-notch, or center-to-center, distance has been set. The required inter-notch distance is set into the apparatus with the index arm 102 in its neutral position. The setting may be accomplished either after or preferably before the first notch is cut. The knob 110*i* associated with the variable spacing control assembly 110 is loosened and the assembly 110 is slid along the slots 102*a*, 36*d* until the pointer 110*g* on the pusher 110*d* is adjacent the marking on the setting scale 39 which corresponds to the required inter-notch distance for the particular key to be cut. The knob 110*i* is then tightened to effectively make the index arm 102 and the variable spacing control assembly 110 a single unit.

After the inter-notch distance has been established and the first notch cut, the second and subsequent notches are cut by registering the index pin 100*c* with the second and subsequent index holes 90 and by making the necessary depth adjustment at each indexing point before the notch is cut. For example, the second notch is cut by lifting the index pin 100*c* from the first index hole 90*a*, rotating the index arm 102 clockwise and registering the index pin 100*c* with the second index hole 90*b*. During this motion the pusher 110*d* bears against the side wall of the slot 36*d* in the longitudinal carriage 36 and moves it linearly the required inter-notch distance. Once the index pin 100*c* is registered with the second index hole 90*b* and the position of the carriage assembly 30 is adjusted to establish the correct notch depth, the second notch may be cut. The third and remaining notches are likewise cut in this fashion.

FIG. 16 shows the index pin 100*c* in the third index hole 90*c*; this figure in conjunction with FIG. 2 clearly suggests the progressive motion of the longitudinal carriage across the face of the cutter 18 and highlights S the interaction of the index arm 102, variable spacing control assembly 110 and longitudinal carriage 36. FIGS. 2 and 16 also help in visualizing the scissoring effect of the slots 102*a*, 36*d* as the longitudinal carriage 36 is incrementally moved. (In FIG. 16 the clamp 60 has been broken away to more clearly show the tongue 42*a* of the movable shoulder locator table 42).

A portable key blank cutting apparatus having many advantages over prior art machines has been disclosed. No inventory of coded cams, plates or discs is required to enable the operator to cut a wide variety of key types, rather, a simple adjustment to a slidable element allows the operator to choose from a range of inter-notch distances. The overall size of the machine and the proportions of its various elements can be increased to permit cutting of keys having more than the commonly found five or six notches. In addition the locksmith can develope his own codes and cut keys to his specifications.

Modifications and variations of many of the elements comprising the apparatus disclosed herein are possible in view of the foregoing description, hence, within the scope of the appended claims, the invention may be practiced otherwise than as specifically described.

I claim:

1. Key blank cutting apparatus, for cutting longitudinally spaced notches in the blade of a key blank, comprising:

a base;

a cutter secured to said base;

a carriage assembly including a longitudinal carriage and a lateral carriage;

said lateral carriage movably mounted on said base for motion toward and away from said cutter;

said longitudinal carriage carried by and movably mounted on said lateral carriage for independent longitudinal motion with respect to said cutter and with respect to said lateral carriage motion;

positioning means movably mounted on said longitudinal carriage, for longitudinally positioning said key blank with respect to the cutter to juxtapose with the cutter that portion of the key blank blade where the first notch is to be cut;

means connected to said positioning means for clamping said key blank to said longitudinal carriage and for immobilizing said positioning means;

means secured to the base for moving said carriage assembly toward and away from said cutter; and means operatively connected to the lateral carriage for moving said longitudinal carriage longitudinally with respect to said cutter in predetermined equal linear increments.

2. A key blank cutting apparatus according to claim 1 wherein said longitudinal carriage is provided with an elongated slot and said lateral carriage is provided with a plurality of index holes and said means for moving said longitudinal carriage comprises:

an index arm provided with an elongated slot intermediate its ends, one end of said index arm pivotally mounted on said lateral carriage;

an engagement means, secured to the other end of said index arm, for engaging a selected one of said plurality of index holes; and control means for selecting said predetermined equal linear increments, said control means extending through both said slots and movable along a predetermined length of both said slots to a selected position for securement to said index arm at said selected position.

3. Key blank cutting apparatus according to claim 2 wherein said control means includes:

a clamp arranged for captured sliding motion within the index arm slot;

a partially threaded post secured to said clamp and projecting upwardly therefrom;

a bored cylindrically shaped pusher captively held by said post, said pusher having a diameter smaller than the width of the slot in the longitudinal carriage and larger than the width of the slot in the index arm; and a knob overlaying said pusher and threadably engaging said post.

4. Key blank cutting apparatus according to claim 3 wherein said positioning means includes:

a table movably mounted on said longitudinal carriage, one end of said table formed as an abutment for said key blank;

a rack secured to the other end of said table; and a pinion rotatably secured to said longitudinal carriage and engaging said rack.

5. Key blank cutting apparatus according to claim 4 wherein said index holes are disposed along an arc.

6. Key blank cutting apparatus according to claim 5 further including:

first indicator means operatively connected to said table for indicating the travel of said table; and second indicator means operatively connected to said carriage assembly for indicating the travel of said carriage assembly toward the cutter.

7. Key cutting apparatus, for cutting a plurality of longitudinally spaced notches in the blade of a key blank, comprising:

a base;

a cutter secured to said base;

a main carriage movably mounted on said base for motion toward and away from said cutter, said main carriage having a plurality of index holes therein;

a sub-carriage carried by said main carriage and movably mounted thereon for independent motion perpendicular to said main carriage motion, said sub-carriage having an elongated slot therein;

positioning means mounted on said sub-carriage for positioning said key blank to a predetermined first position with respect to said cutter;

clamping means, secured to said positioning means for clamping said key blank to said sub-carriage;

means operatively connected to said main carriage for moving said main carriage toward and away from said cutter;

an indexing arm having an elongated slot intermediate its ends, said indexing arm pivotally connected at one end to the main carriage and provided with an index hole engagement means at its other end; and means for having said sub-carriage in equal increments, said means extending through both said slots and securable to said index arm at a predetermined position.

8. Apparatus for cutting a plurality of notches in the blade of a key blank wherein the first notch is spaced a predetermined distance from a reference point on the key blank and the remaining notches are spaced a selected equal distance from each other and the first notch along the remaining portion of the blade, said apparatus comprising:

a base;

cutting means secured to said base and defining machine datum;

a first carriage movably mounted on said base for motion toward and away from said cutting means and parallel to machine datum;

a second carriage mounted on said first carriage for independent motion in a direction perpendicular to machine datum and the first carriage motion;

means connected to said second carriage for spacing the reference point on the key blank a predetermined distance from machine datum;

means operatively connected to said second carriage for clamping the key blank to said second carriage;

means connected to the base for moving the first carriage toward and away from said cutting means; and means operatively connected to said first carriage and said second carriage for sequentially moving said second carriage in selectable equal increments in a direction perpendicular to machine datum.

9. Apparatus according to claim 8 wherein said first carriage is provided with a plurality of index holes and said means for sequentially moving said second carriage includes:

an index arm having one end pivotally mounted on said first carriage;

means secured to the other end of said index arm for engaging a selected one of said plurality of index holes; and means for driving said second carriage, said means selectively securable to said index arm at a predetermined position.

* * * * *